US007605780B2

(12) United States Patent
Jung et al.

(10) Patent No.: US 7,605,780 B2
(45) Date of Patent: Oct. 20, 2009

(54) DISPLAY APPARATUS AND CONTROL METHOD THEREOF

(75) Inventors: Byoung-hwa Jung, Seongnam-si (KR); Jong-sul Min, Hwanseong-si (KR); Young-sun Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 757 days.

(21) Appl. No.: 11/125,125

(22) Filed: May 10, 2005

(65) Prior Publication Data

US 2006/0007250 A1 Jan. 12, 2006

(30) Foreign Application Priority Data

May 25, 2004 (KR) ..... 10-2004-0037183

(51) Int. Cl.
*G09G 3/28* (2006.01)

(52) U.S. Cl. ..... 345/63; 345/60; 345/65; 345/67; 345/71

(58) Field of Classification Search ..... 345/60–69, 345/204, 690, 698, 173, 473, 629, 87, 611, 345/613; 348/790, 714; 315/169.2
See application file for complete search history.

(56) References Cited

U.S. PATENT DOCUMENTS 6,617,797 B2 * 9/2003 Higuchi et al. ..... 315/169.1
6,680,732 B2 * 1/2004 Yoo ..... 345/173
6,686,698 B2 * 2/2004 Takeuchi et al. ..... 315/169.2
6,812,932 B2 * 11/2004 Kasahara et al. ..... 345/613
7,180,481 B2 * 2/2007 Yamada ..... 345/63
7,262,818 B2 * 8/2007 Chuang et al. ..... 348/790
2002/0005857 A1 * 1/2002 Kasahara et al. ..... 345/611
2002/0063701 A1 * 5/2002 Sano et al. ..... 345/204
2002/0145575 A1 * 10/2002 Tong et al. ..... 345/60
2003/0090488 A1 * 5/2003 Yoo ..... 345/473
2003/0173903 A1 * 9/2003 Takeuchi et al. ..... 315/169.2
2003/0210256 A1 * 11/2003 Mori et al. ..... 345/690
2004/0036704 A1 * 2/2004 Han et al. ..... 345/690

(Continued)

FOREIGN PATENT DOCUMENTS

JP 2000-10522 1/2000

(Continued)

OTHER PUBLICATIONS

Korean Official Action dated Oct. 31, 2005, for Korean Patent Application No. 2004-37183.

*Primary Examiner*—Prabodh M Dharia
(74) *Attorney, Agent, or Firm*—Stanzione & Kim LLP

(57) ABSTRACT

A display apparatus having a display part to receive a predetermined weight number of sustain pulses to display a frame of an image time-shared into a plurality of subfields, the display apparatus includes a motion detector to determine whether an input image is a still image, and a pulse driver to transmit a number of sustain pulses to the display part, and to decrease the number of sustain pulses transmitted to the display part to cause every frame to be smaller than the weight number when the motion detector determines the input image to be the still image. In this display apparatus and control method thereof, image sticking is prevented without deteriorating gradation representation and without a visual error.

22 Claims, 6 Drawing Sheets

U.S. PATENT DOCUMENTS

| | | | | |
|---|---|---|---|---|
| 2004/0233229 | A1* | 11/2004 | Kimura | 345/690 |
| 2004/0246207 | A1* | 12/2004 | Yamada | 345/63 |
| 2005/0057580 | A1* | 3/2005 | Yamano et al. | 345/690 |
| 2005/0162566 | A1* | 7/2005 | Chuang et al. | 348/714 |
| 2007/0075929 | A1* | 4/2007 | Yamada | 345/63 |

FOREIGN PATENT DOCUMENTS

| | | |
|---|---|---|
| JP | 2000-338933 | 12/2000 |
| JP | 2001-75529 | 3/2001 |
| JP | 2003-308041 | 10/2003 |
| KR | 2003-88538 | 11/2003 |

* cited by examiner

DISPLAY APPARATUS AND CONTROL METHOD THEREOF

CROSS-REFERENCE TO RELATED APPLICATIONS

This application claims the benefit of Korean Patent Application No. 2004-37183, filed on May 25, 2004, in the Korean Intellectual Property Office, the disclosure of which is incorporated herein by reference.

BACKGROUND OF THE INVENTION

1. Field of the Invention

The present general inventive concept relates to a display apparatus and a control method thereof, and more particularly, to a display apparatus and a control method thereof, in which image sticking is removed to protect a screen thereof.

2. Description of the Related Art

Image sticking is a phenomenon that a still image displayed for a long time remains on a screen while the screen displays a following image. The image sticking acts as noise in a displaying image, and may damage a display apparatus.

A display apparatus, such as a plasma display panel (PDP), a digital mirror device (DMD), etc., which processes a video signal by a time-sharing method, is susceptible to the image sticking. Particularly, when the still image has a high brightness and is displayed for a long time, a wall charge of a discharging cell allowing a pixel to emit light is not completely discharged and remains, so that the image sticking arises in the following moving picture frame. In a bad case, the image sticking may damage the discharging cell.

To prevent the image sticking from arising, there have been proposed various methods.

As an example, there is a method of decreasing the brightness of an image when the image is input as the still image. However, in this method, the brightness level is decreased without considering dark and bright regions of the still image, so that a gradation representation in the dark region is deteriorated.

Further, there is a method of slightly moving a position of the still image in up, down, left and right directions, to thereby allow the pixel to display the still image as if it is a moving picture. However, in this method, it is understood that a user still recognizes the movement of the still image even if the movement is very slight.

Yet further, there is a method of adding black/white lines to the still image, wherein adding positions are changed according to times. In this method, the image sticking is prevented because the same brightness is not applied to the same pixel for a long time. However, this method is inadequate to satisfying a user requiring a high definition display apparatus.

SUMMARY OF THE INVENTION

Accordingly, the present general inventive concept provides a display apparatus and a control method thereof, in which image sticking is prevented without deteriorating a gradation representation and without a visual error.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept may be achieved by providing a display apparatus having a display part to receive a predetermined weight number of sustain pulses to display a frame of an image time-shared into a plurality of subfields, the display apparatus comprising a motion detector to determine whether an input image is a still image, and a pulse driver to transmit a number of sustain pulses to the display part, and to decrease the number of sustain pulses transmitted to the display part to cause every frame to be smaller than the weight number when the motion detector determines the input image to be the still image.

The display apparatus may further comprise a history estimator to estimate history information about a determination result of the motion detector up to a current frame, wherein the pulse driver decreases the number of sustain pulses in proportion to the number of frames determined by the motion detector as the still image on the basis of the history information estimated by the history estimator.

The display apparatus may further comprise a high brightness detector to detect a pixel having a brightness level higher than a reference brightness, and a gradation limiter to decrease the brightness level of a high brightness pixel detected by the high brightness detector when the motion detector determines the input image to be the still image, wherein the display part displays the high brightness pixel in correspondence to the brightness level decreased by the gradation limiter.

The high brightness detector may detect a region having a brightness level higher than a reference brightness, and the gradation limiter may decrease the brightness level of a high brightness region detected by the high brightness detector when the motion detector determines the input image to be the still image, wherein the display part displays the high brightness region in correspondence to the brightness level decreased by the gradation limiter.

The motion detector may store information about a still image pixel displaying the still image. The display apparatus may further comprise a brightness detector to detect whether the still image pixel has a brightness level higher than a reference brightness level, and the gradation limiter may decrease the brightness level of a high brightness still image pixel detected by the high brightness detector when the motion detector determines the input image to be a non-still image.

The motion detector may determine whether the input image includes the still image by at least one region unit forming the frame.

The reference brightness level may be decreased in proportion to a number of times that the motion detector determines the input image as the still image.

The gradation limiter may comprise an average picture level estimator to calculate an average picture level of the pixels forming the frame and to allow the pulse driver to determine the number of sustain pulses.

The foregoing and/or other aspects and advantages of the present general inventive concept may also be achieved by providing a display apparatus having a display part to receive a predetermined weight number of sustain pulses to display a frame of an image time-shared into a plurality of subfields, the display apparatus comprising a high brightness detector to detect a high brightness pixel having a brightness level higher than a reference brightness, a motion detector to determine whether a high brightness pixel includes a still image, and a gradation limiter to transmit the brightness level of the pixel to the display part and to decrease the brightness level of the high brightness pixel detected by the high brightness detector when the motion detector determines the input image as the still image.

The gradation limiter may decrease the brightness level of the high brightness pixel in proportion to the number of times that the motion detector determines the input image as the still image up to the current frame.

The foregoing and/or other aspects and advantages of the present general inventive concept may also be achieved by providing a method of controlling a display apparatus having a display part to receive a predetermined weight number of sustain pulses to display a frame of an image time-shared into a plurality of subfields, the method comprising determining whether an input image is moving, and at least decreasing the number of sustain pulses transmitted to the display part every frame when the input image is determined to be a still image, and transmitting the decreased sustain pulses to the display part.

The method may further comprise detecting a high brightness pixel having a brightness level higher than a reference brightness level, and decreasing the brightness level of the high brightness pixel when the input image is determined to be the still image.

the method may further comprise storing the detected result of the input image by a pixel unit, determining whether a still image pixel by the detected result has the brightness level higher than the reference brightness level, and decreasing the brightness level of the still image pixel having the brightness level higher than the reference brightness level when the input image is determined to be a non-still image.

The method may further comprise estimating history information about the input image detected result up to the current frame, the number of sustain pulses being decreased in proportion to the number of frames of which the input image is determined to be the still image on the basis of the estimated history information.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
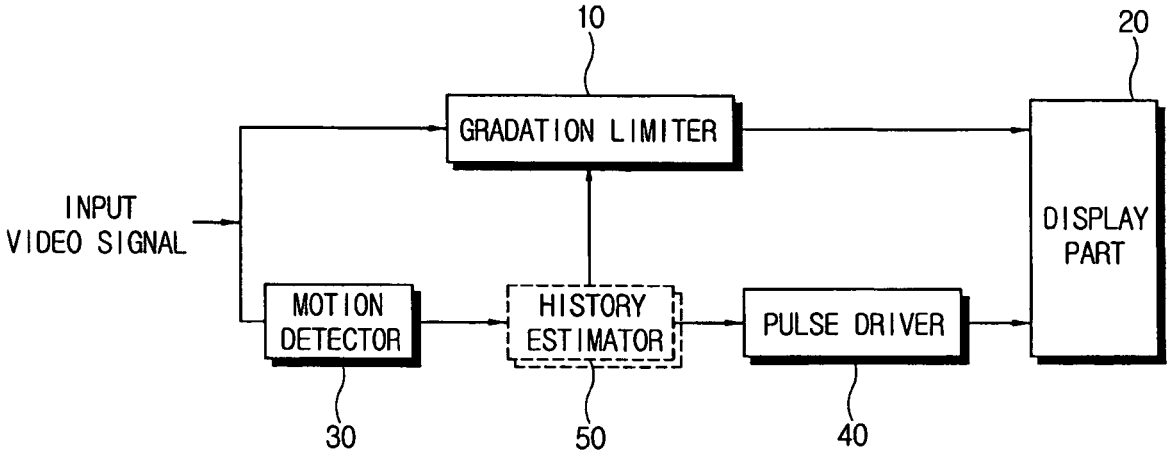
FIG. 1 is a block diagram illustrating a display apparatus according to an embodiment of the present general inventive concept.

Reference will now be made in detail to the embodiments of the present general inventive concept, examples of which are illustrated in the accompanying drawings, wherein like reference numerals refer to like elements throughout. The embodiments are described below in order to explain the present general inventive concept by referring to the figures.

FIG. 1 is a block diagram illustrating a display apparatus according to an embodiment of the present general inventive concept.

As shown in FIG. 1, the display may comprise a gradation limiter 10, a display part 20, a motion detector 30, and a pulse driver 40.

The gradation limiter 10 converts a brightness level of an input video signal into a proper gradation level. Generally, the gradation limiter 10 may perform a reverse gamma correction, an error diffusion, etc., and output a proper subfield codeword to the display part 20. Here, the subfield codeword may be a stream of binary data indicating gradations according to pixels, wherein the binary data of a subfield (to be described later) indicates whether the pixel emits light.

Figure 2:
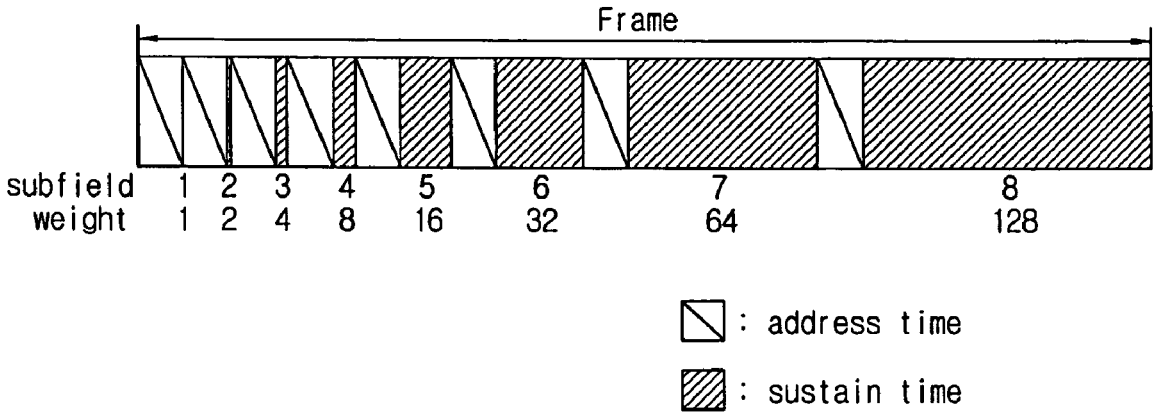
FIG. 2 is a view illustrating a subfield and a frame.

The display part 20 receives a predetermined weight number of sustain pulses for one frame. Generally, the sustain pulse may be a common signal commonly input to each pixel, and the number of sustain pulses may be properly weighted by the frame or the subfield. As shown in FIG. 2, one frame may comprise eight subfields, and the eight subfields can be weighted by 1, 2, 4, 8, 16, 32, 64 and 128 sustain pluses, respectively. Hence, the total weighted number of sustain pulses per one frame is 255.

Each subfield of one frame can be divided into address time and sustain time. The address time is a period to select the pixel to emit light in each subfield, and the sustain time is a period to allow the selected pixel to emit light accordingly, as the sustain pulses weighted in each subfield are transmitted to the display part 20. For example, when the pixel has a subfield codeword of [10000001], the first and eighth subfields emit light, thereby allowing the pixel to emit light during the time corresponding to 129 sustain pulses.

Referring to FIG. 1, the motion detector 30 determines whether the input video signal is for a still image. Here, the determination may be performed by one frame of an image, that is, by one screen. However, the determination may also be performed according to a still region and a moving region, that is, by a region or a block. Further, as a detecting method, there may be a motion estimation method to estimate a motion vector between a prior frame and a current frame according to the blocks having a predetermined size, a motion detection method to detect a change in image data of the pixel, etc.

The pulse driver 40 may comprise a driving IC (integrated chip) to generate the number of sustain pulses to the display part 20, and to adjust the number of sustain pulses to be transmitted to the display part 20.

Hereinbelow, operations of the display apparatus of FIG. 1 will be described.

The motion detector 30 determines whether the input video signal is the still image. At this time, the motion detector 30 can easily determine whether the image is moving using the following method. That is, in the case where the determination is performed on one screen, an image data difference between the video signal delayed by one frame and the input video signal corresponding to a pixel of the same position as the delayed video signal can be calculated. When a number of pixels having a larger image data difference than a predetermined difference value is larger than a predetermined number, the input image is determined to be the moving picture. Contrarily, when the number of pixels having a larger image data difference than the predetermined difference value is smaller than the predetermined number, the input image is determined to be the still image.

Subsequently, in a case where the motion detector 30 determines the input image to be the still image, the pulse driver 40 decreases the number of sustain pulses transmitted to the display apparatus 20 per one frame. Here, the decrement in the number of sustain pulses can be achieved by decreasing the weighted sustain pulses of each subfield. Thus, the image sticking is prevented by reducing a discharging time of each discharging cell without changing each gradation representation.

The discharging time may be adjusted according to the sustaining time of the still image.

For this, as shown in FIG. 1, the display apparatus may further comprise a history estimator 50 to estimate history information about the detection result of the motion detector 30 up to the current frame.

The history estimator 50 can estimate the history information by various data types. That is, after the input image is determined to be the moving picture, the times of detecting the still picture can be continuously counted. In this case, the history information can be reset when the moving picture is detected again. Alternatively, the history information may be estimated by applying predetermined weights to the still image and the moving picture and then adding or subtracting each weight according to detected results of the motion detector 30. Additionally, various other methods can be used to estimate the history information.

The estimated history information can be input to the pulse driver 40, and the pulse driver 40 controls the number of the sustain pulses transmitted to the display part 20 per one frame. For example, referring to FIG. 2, the pulse driver 40 can decrease the number of sustain pulses from 255 into 230 when there is input a series of two still images. Then, when the still image is inputted again, the pulse driver 40 can decrease the number of sustain pulses from 230 into 200. Thus, the number of sustain pulses can be decreased in proportion to input times of the still images, to thereby effectively prevent the image sticking. The proportion for decreasing the number of sustain pulses can vary properly according to a system designer's selection.

Figure 3:
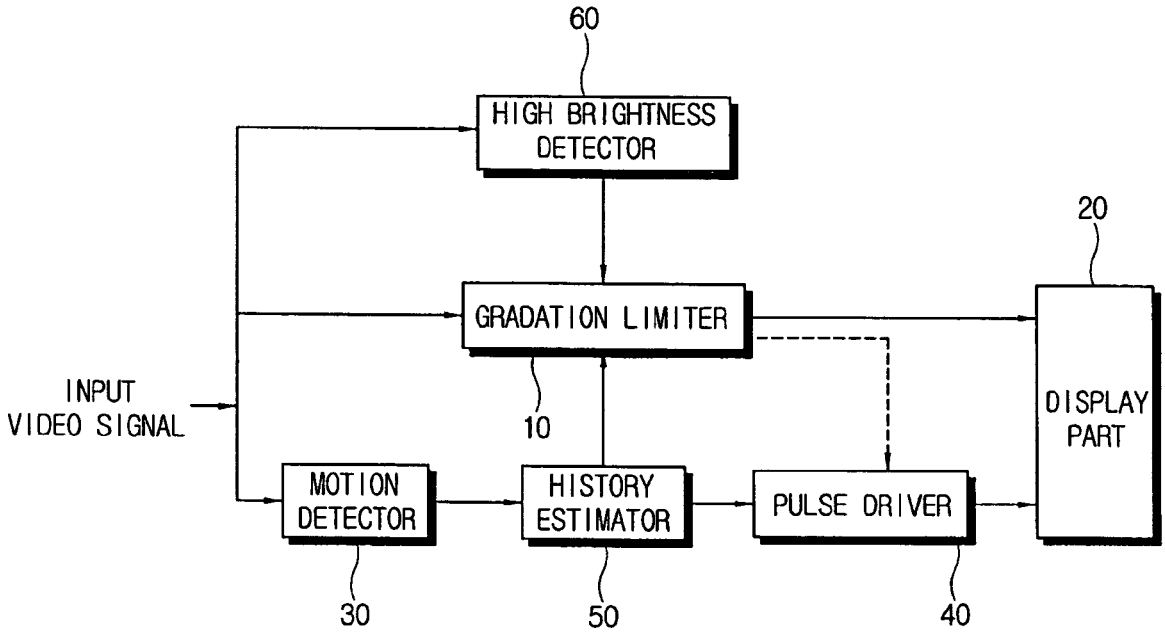
FIG. 3 is a schematic block diagram illustrating a display apparatus according to another embodiment of the present general inventive concept.

FIG. 3 is a schematic block diagram illustrating a display apparatus according to another embodiment of the present general inventive concept. The display apparatus may comprise a high brightness detector 60 in addition to the gradation limiter 10, the display part 20, the motion detector 30, the pulse driver 40, and the history estimator 50, as shown in FIG. 1. Therefore, the display apparatus of FIG. 3 will be described hereinbelow, focusing on a difference from the display apparatus of FIG. 1.

The high brightness detector 60 can detect a pixel having a brightness level higher than a reference brightness level, or detect a region having an average brightness level higher than the reference brightness level.

The motion detector 30 can store information about the pixel displaying the still image. That is, the motion detector 30 can separately manage the information about the region or the pixels displaying the still picture even though it determines that the screen displays the moving picture.

The gradation limiter 10 limits the gradation of the still image pixel or the still image region having the high brightness, and can output the subfield codeword corresponding to the limited gradation to the display part 20 directly or through the pulse driver 40 to allow the pulse driver to decrease the number of sustain waives of the still image pixel or the still image region.

Figure 4:
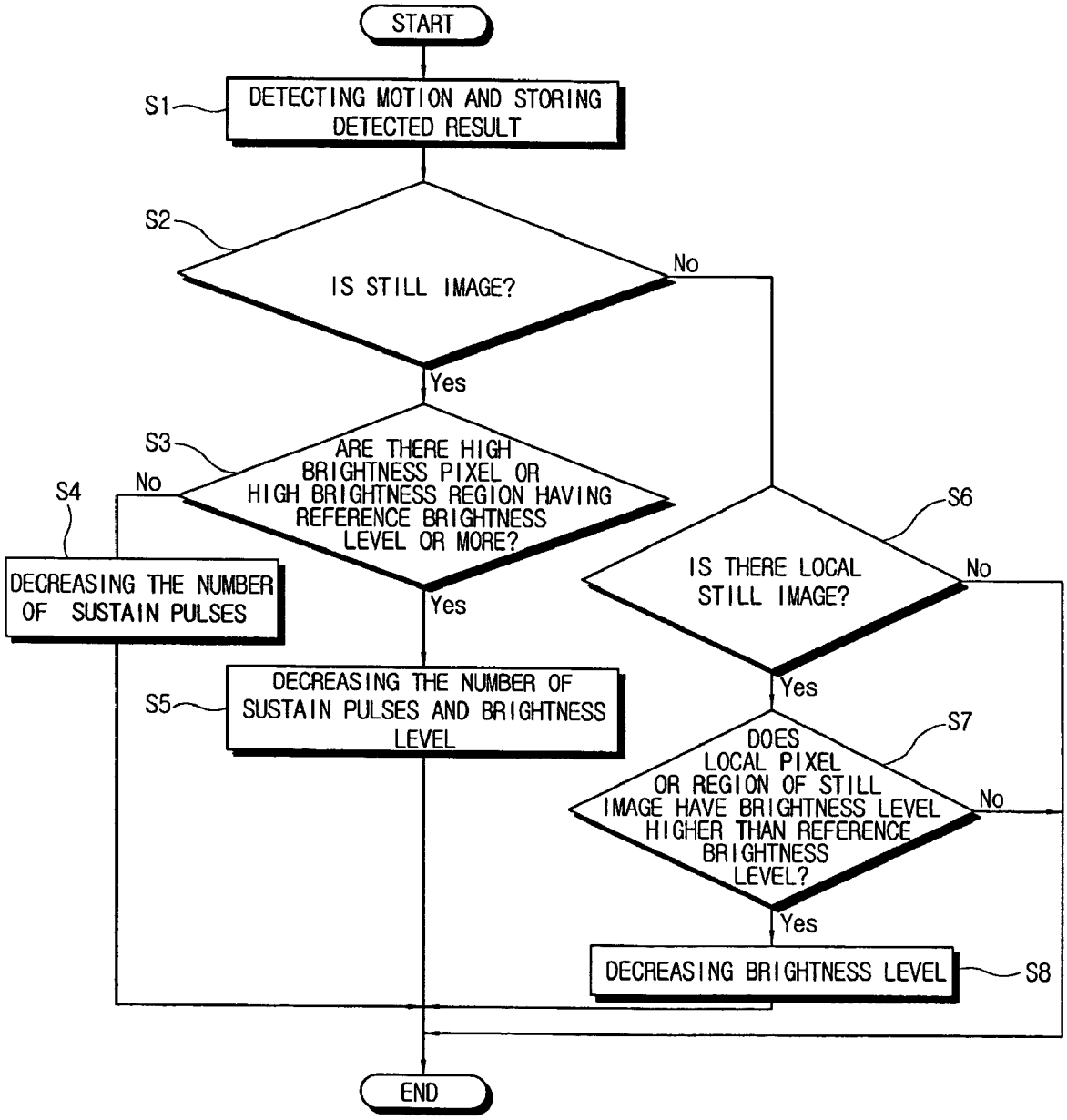
FIG. 4 is a control flowchart illustrating an operation of the display apparatus of FIG. 3.

FIG. 4 is a control flowchart illustrating an operation of the display apparatus of FIG. 3. Hereinbelow, controlling operation of the display apparatus of FIG. 3 will be described with reference to FIGS. 3 and 4.

First, a video signal can be input to the motion detector 30, the high brightness detector 60, and the gradation limiter 10.

At operation S1, the motion detector 30 determines whether the input image frame is a still image, and stores the detected result by a pixel unit or a region unit. Here, a detecting unit may include the whole frame or a partial region, and the motion detector 30 can store information about a local still image region or a still image pixel even though the detecting unit may be determined to be the moving picture. Further, the detected result in the current frame can be given to the history estimator 50 as history information.

Then, in a case where the input image in the current frame is determined to be the still image at operation S2, the pulse driver 40 can decrease the number of sustain pulses and transmit the decreased number of sustain pulses to the display apparatus 20 at operations S4 and S5, and can increase a decreasing ratio of the sustain pulses on the basis of the history information of the history estimator 50.

The high brightness detector 60 compares a brightness level of the input image with a reference brightness level at operation S3, and if the brightness level of the input image is higher than the reference brightness level, the high brightness detector transmits information about a high brightness pixel and a high brightness region to the gradation limiter 10.

The gradation limiter 10 decreases the gradation level of the high brightness pixel and the high brightness region at operation S5 when the input image is determined to have a high brightness level at operation S3.

Figure 5:
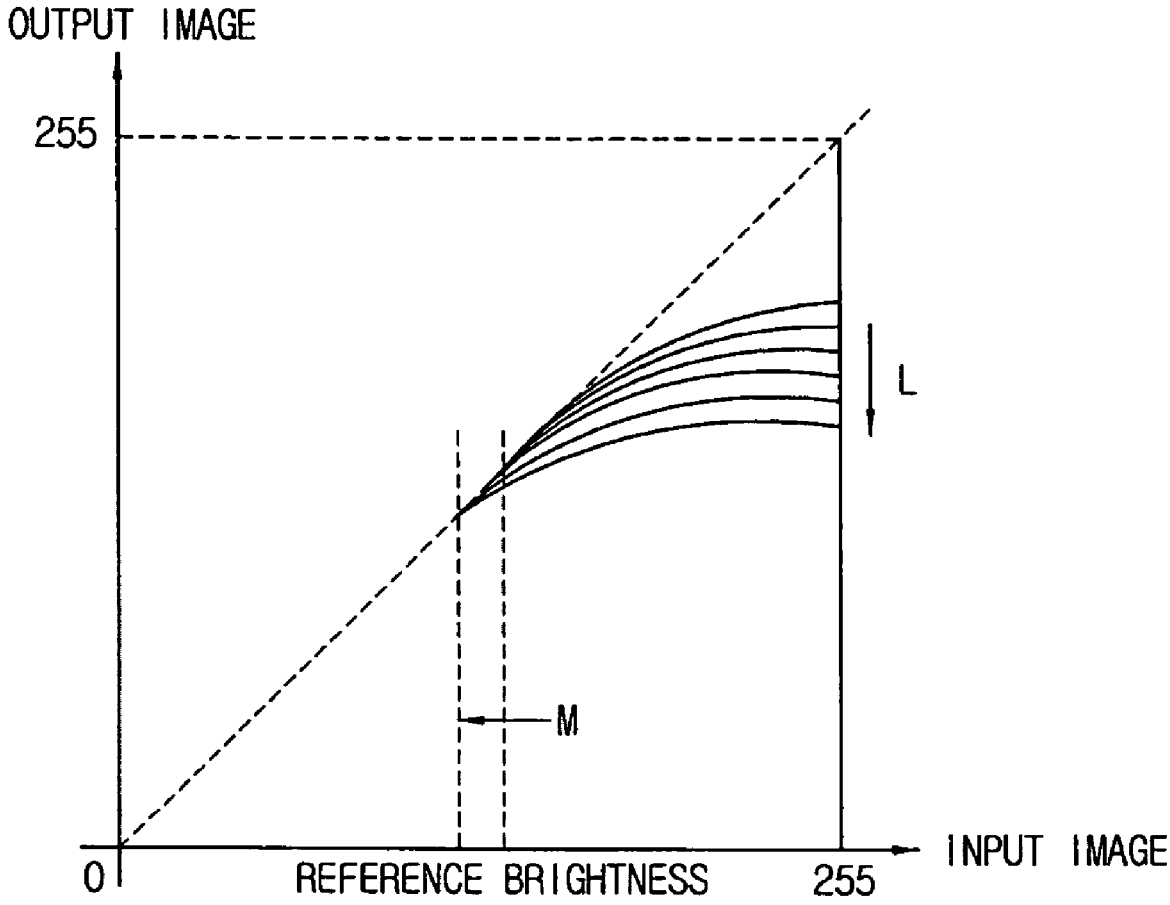
FIG. 5 is a graph illustrating that a brightness level of a high brightness image is decreased in correspondence to history information.

For example, the gradation level of the output image with respect to the input image having a predetermined reference brightness level or more is decreased like the graph shown in FIG. 5. Particularly, the decreasing ratio of the gradation level is weighted (refer to "L") by the history information of the history estimator 50, and then adjusted by the gradation limiter 10. That is, the more the number of the consecutively input still images is increased, the wider the decreasing ratio of the gradation level is.

On the other hand, the gradation limiter 10 does not change the gradation in the case of the gradation level having the reference brightness level or below, as determined at operation S3. However, the reference brightness level (refer to "M") can be gradually decreased on the basis of the history information of the history estimator 50, e.g., according to the sustain time of the still image.

Thus, the gradation decreasing ratio "L" and the reference brightness "M" can vary according to the history information, so that the image sticking with respect to the high brightness pixel and the high brightness region is effectively prevented.

Meanwhile, when the motion detector 30 determines the input image to be the moving picture, the local still image pixel and the still region detected by the motion detector 30 can be separately prevented from having the image sticking.

That is, in the case where the whole frame is determined to be the moving picture but has the local still image pixel and the still image region at operation S6, the high brightness detector 60 determines whether the local still image pixel and the still image region have the brightness level higher than the reference brightness level at operation S7.

When each of the local still image pixel and the still image region has the brightness level higher than the reference brightness level, the gradation limiter 10 decreases each gradation level thereof and outputs the decreased gradation level to the display part 20, at operation S8. Thus, the local image sticking is prevented with respect to the moving picture.

Here, the gradation limiter 10 may further comprise an average picture level (APL) estimator to calculate an average picture level and to adjust the number of sustain pulses on the basis of the calculated average picture level. Thus, the history information of the history estimator 50 can be added to the calculation of the APL estimator and reflected when the pulse driver 40 determines the number of sustain pulses.

Figure 6:
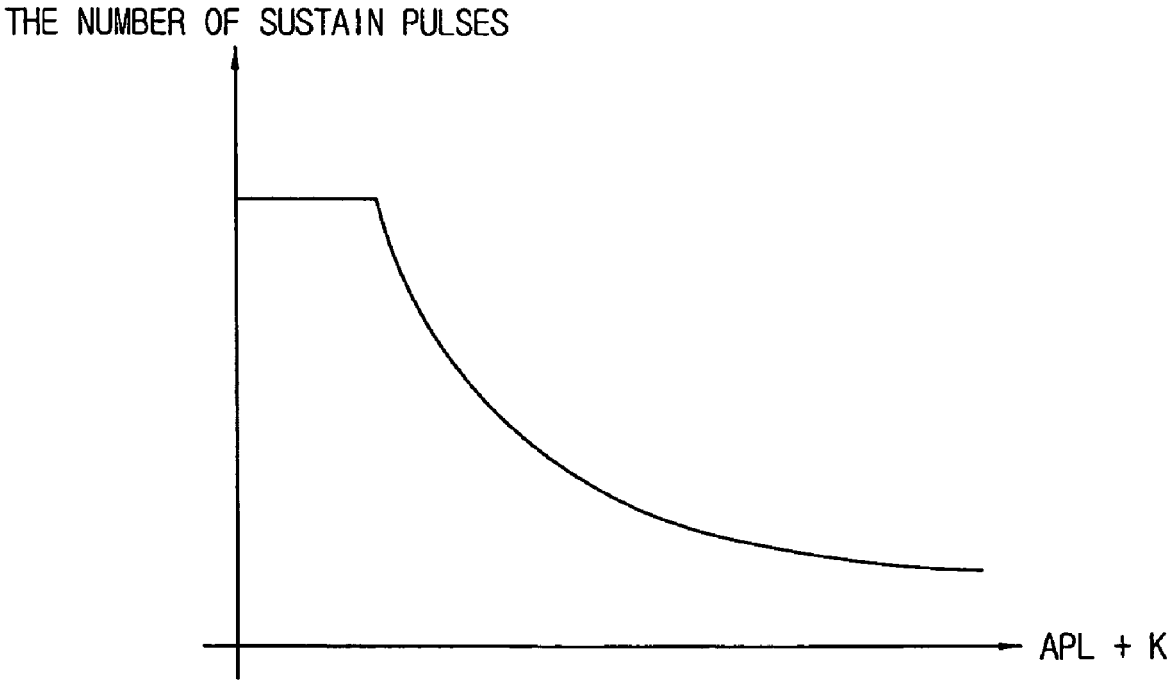
FIG. 6 is a graph illustrating that a number of sustain pulses is determined by adding the history information to a change in an average picture level.

FIG. 6 is a graph illustrating that the number of sustain pulses is determined by weighting the history information to a change in an average picture level.

The APL estimator can calculate the average picture level of the pixels forming the frame, and then allow the pulse driver 40 to determine the number of sustain pulses. Here, a weight "K" based on the history information can be added to the average picture level, so that the number of sustain pulses can be decreased with respect to the same average picture level.

As described above, various embodiments of the present general inventive concept provide a display apparatus and a control method thereof, in which image sticking is prevented without deteriorating gradation representation and without a visual error.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A display apparatus having a display part to receive a predetermined weight number of sustain pulses to display a frame of an image time-shared into a plurality of subfields, the display apparatus comprising:

a motion detector to determine whether an input image is a still image; and a pulse driver to transmit a number of sustain pulses to the display part, and to decrease the number of sustain pulses transmitted to the display part to cause every frame of the input image to be smaller than the weight number in proportion to a number of frames determined by the motion detector to be the still image region when the motion detector determines the input image to be the still image.

2. The display apparatus according to claim 1, further comprising:

a history estimator to estimate history information about a determination result of the motion detector up to a current frame, wherein the pulse driver decreases the number of sustain pulses in proportion to a number of frames determined by the motion detector to be the still image on the basis of the history information estimated by the history estimator.

3. The display apparatus according to claim 1, further comprising:

a high brightness detector to detect a high brightness pixel having a brightness level higher than a reference brightness; and a gradation limiter to decrease the brightness level of the high brightness pixel detected by the high brightness detector when the motion detector determines the input image to be the still image, wherein the display part displays the high brightness pixel in correspondence to the brightness level decreased by the gradation limiter.

4. The display apparatus according to claim 3, wherein the reference brightness level is decreased in proportion to the number of times that the motion detector determines the input image to be the still image.

5. The display apparatus according to claim 3, wherein the gradation limiter comprises an average picture level estimator to calculate an average picture level of pixels forming the frame and to allow the pulse driver to determine the number of sustain pulses.

6. The display apparatus according to claim 1, further comprising;

a high brightness detector to detect a high brightness region having a brightness level higher than a reference brightness; and a gradation limiter to decrease the brightness level of the high brightness region detected by the high brightness detector when the motion detector determines the input image as the still image, wherein the display part displays the high brightness region in correspondence to the brightness level decreased by the gradation limiter.

7. The display apparatus according to claim 6, wherein the reference brightness level is decreased in proportion to the number of times that the motion detector determines the input image to be the still image.

8. The display apparatus according to claim 6, wherein the gradation limiter comprises an average picture level estimator to calculate an average picture level of pixels forming the frame and to allow the pulse driver to determine the number of sustain pulses.

9. The display apparatus according to claim 1, wherein the motion detector stores information about a still image pixel displaying the still image, and the display apparatus further comprises:

a brightness detector to detect whether the still image pixel is high brightness still image pixel having a brightness level higher than a reference brightness level; and a gradation limiter to decrease the brightness level of the high brightness still image pixel detected by the high brightness detector when the motion detector determines the input image to be a non-still image.

10. The display apparatus according to claim 9, wherein the reference brightness level is decreased in proportion to the number of times that the motion detector determines the input image to be the still image.

11. The display apparatus according to claim 9, wherein the gradation limiter comprises an average picture level estimator to calculate an average picture level of pixels forming the frame and to allow the pulse driver to determine the number of sustain pulses.

12. The display apparatus according to claim 1, wherein the motion detector determines whether the input image includes the still image by at least one region unit forming the frame.

13. A display apparatus having a display part receiving a predetermined weight number of sustain pulses to display a frame of an image time-shared into a plurality of subfields, the display apparatus comprising:

a high brightness detector to detect a high brightness pixel having a brightness level higher than a reference brightness;

a motion detector to determine whether the high brightness pixel includes a still image; and a gradation limiter to transmit a brightness level of a pixel to the display part, the brightness level represented by at least two sustain time to define an address time between the sustain pulses, and to decrease the brightness level of the high brightness pixel detected by the high brightness detector according to the number of time that the motion detector determines the input image to be the still image when the motion detector determines the input image to be the still image.

14. The display apparatus according to claim 13, wherein the gradation limiter decreases the brightness level of the high brightness detector in proportion to the number of times that the motion detector determines the input image to be the still image up to a current frame.

15. The display apparatus according to claim 13, further comprising:

a pulse driver to decrease the number of sustain pulses, wherein when the input image comprises the still image and a moving image within a frame, and the pulse driver decreases the number of sustain pulses according to a status of the still image.

16. The display apparatus according to claim 13, further comprising:

a pulse driver to decrease the number of sustain pulses, wherein when the input image comprises a still image and a moving image within a frame, and the pulse driver decreases a number of sustain pulses according to a brightness level of the still image.

17. A method of controlling a display apparatus having a display part to receive a predetermined weight number of sustain pulses to display a frame of an image time-shared into a plurality of subfields, the method comprising:

determining whether an input image is moving; and at least decreasing the number of sustain pulses transmitted to the display part every frame according to a number of frames of the input image determined to be a till image, and transmitting the decreased sustain pulses to the display part.

18. The method according to claim 17, further comprising:

detecting a high brightness pixel having brightness level higher than a reference brightness level; and decreasing the brightness level of the high brightness pixel when the input image determined to be the still image.

19. The method according to claim 17, further comprising;

storing the detected result of the input image by a pixel unit;

determining whether a still image pixel by the detected result has a brightness level higher than a reference brightness level;

decreasing the brightness level of the still image pixel having the brightness level higher than the reference brightness level when the input image is determined to be a non-still image.

20. The method according to claim 17, further comprising estimating history information about the input image determination up to the current frame, the number of sustain pulses being decreased in proportion to the number of frames of which the input image is determined to be the still image on the basis of the estimated history information.

21. The method according to claim 17, wherein the determining of whether the input image is moving comprises:

determining whether a portion of the input image is still;

determining whether the portion of the input image determined to be still has a high brightness level; and decreasing the brightness level of the portion of the image if the brightness level is determined to be high.

22. The method according to claim 21, further comprising:

estimating a history of the determination of whether the input image is moving; and decreasing the number of sustain pulses proportionally to the estimated history.

* * * * *

UNITED STATES PATENT AND TRADEMARK OFFICE

CERTIFICATE OF CORRECTION

PATENT NO. : 7,605,780 B2
APPLICATION NO. : 11/125125
DATED : October 20, 2009
INVENTOR(S) : Jung et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1198 days.

Signed and Sealed this

Fifth Day of October, 2010

David J. Kappos

David J. Kappos
*Director of the United States Patent and Trademark Office*